US010899528B2

(12) United States Patent
Merjuste et al.

(10) Patent No.: US 10,899,528 B2
(45) Date of Patent: Jan. 26, 2021

(54) FLUID DISPENSING BOTTLE CAP AND BOTTLE SYSTEM

(71) Applicants: Jonathan Merjuste, Kissimmee, FL (US); Jacqueline Merjuste, Kissimmee, FL (US)

(72) Inventors: Jonathan Merjuste, Kissimmee, FL (US); Jacqueline Merjuste, Kissimmee, FL (US)

( * ) Notice: Subject to any disclaimer, the term of this patent is extended or adjusted under 35 U.S.C. 154(b) by 120 days.

(21) Appl. No.: 16/146,414

(22) Filed: Sep. 28, 2018

(65) Prior Publication Data

US 2020/0102137 A1 Apr. 2, 2020

(51) Int. Cl.
*B65D 81/32* (2006.01)

(52) U.S. Cl.
CPC ..... *B65D 81/3216* (2013.01)

(58) Field of Classification Search
CPC ..... B65D 81/3216; B65D 51/2821; B65D 25/08; B65D 25/087; B65D 51/2807; B65D 51/2875; B65D 51/2864; B65D 81/3238; B65D 81/3211; B65D 81/3266; A61J 1/2093
USPC ..... 206/219–222
See application file for complete search history.

(56) References Cited

U.S. PATENT DOCUMENTS 5,979,164 A * 11/1999 Scudder ..... A47J 36/28 62/4
6,786,330 B2 * 9/2004 Mollstam ..... B65D 47/2031 206/219
8,511,465 B2 * 8/2013 Seelhofer ..... B65D 51/2821 206/219
2004/0026270 A1 * 2/2004 Liang ..... B65D 51/2821 206/219
2007/0023300 A1 * 2/2007 Spector ..... B65D 51/2828 206/222
2007/0102306 A1 * 5/2007 Lantos ..... B65D 47/243 206/219
2009/0236303 A1 * 9/2009 Lizerbram ..... B65D 47/243 215/227
2011/0240172 A1 * 10/2011 Eidam ..... A61J 1/2089 141/1
2011/0278184 A1 * 11/2011 Middleman ..... A47G 21/00 206/222
2012/0285985 A1 * 11/2012 Jones ..... B65D 51/2821 222/1
2014/0216958 A1 * 8/2014 Seelhofer ..... B65D 81/24 206/219
2018/0186528 A1 * 7/2018 Tonn ..... B65D 81/3216

FOREIGN PATENT DOCUMENTS

EP 0186502 A2 * 7/1986 ..... A61J 7/00

* cited by examiner

*Primary Examiner* — Chun Hoi Cheung
(74) *Attorney, Agent, or Firm* — Jason T. Daniel, Esq.; Daniel Law Offices, P.A.

(57) ABSTRACT

A fluid dispensing bottle cap includes a cap body having a closed top end and an open bottom end. A hollow reservoir is positioned within the interior space of the cap body and is accessible via an aperture that extends through the top end of the cap body. The reservoir is constructed from a resilient material and has a slit along the bottom end for discharging a stored liquid. Another embodiment of the present invention includes a dispensing valve that is positioned within the reservoir body to release a measured amount of the stored liquid upon receiving a pressing force.

12 Claims, 5 Drawing Sheets

FLUID DISPENSING BOTTLE CAP AND BOTTLE SYSTEM

TECHNICAL FIELD

The present invention relates generally to beverage containers, and more particularly to a bottle cap having a stored fluid that can be selectively discharged.

BACKGROUND

The statements in this section merely provide background information related to the present disclosure and may not constitute prior art.

Beverage manufacturers prepare and ship beverages that are intended to be pleasing to the masses. Owing to the large-scale preparation and distribution involved in providing canned and/or bottled beverages, manufacturers are unable to provide much variation to the sweetness or flavor profile of their products. Even if such a process were possible, the "customized" beverage would still not be desirable to every consumer due to the inherent differences in each person's palate.

As such, users who desire to change the sweetness level of a beverage must physically obtain a sweetener and then must go through the process of pouring the sweetener into the (often too small) opening of the beverage container. However, if a user wishes to change the flavor profile of the beverage and/or add a secondary flavor (e.g., adding raspberry flavor to iced tea) the user has no easy option for achieving this result.

Accordingly, it would be beneficial to provide a fluid dispensing bottle cap that can be manufactured to include any type of flavor additive, in order to allow a user to customize a beverage to suit their individual palate, thereby overcoming the drawbacks described above. It would also be beneficial to provide a bottle system having a bottle for storing a beverage and a bottle cap containing a flavor additive.

SUMMARY OF THE INVENTION

The present invention is directed to fluid dispensing bottle cap. One embodiment of the present invention can include a cap body having a closed top end and an open bottom end. A hollow reservoir can be positioned within the interior space of the cap body and can be accessible via an aperture that extends through the top end of the cap body. The reservoir can be constructed from a resilient material and can include a slit along the bottom end for discharging the liquid upon receiving a pressing force onto the reservoir body.

Another embodiment of the present invention can include a dispensing valve that is positioned within the reservoir body. The dispensing valve functioning to release a measured amount of the stored fluid upon receiving a pressing force.

Yet another embodiment of the present invention can include a system having a bottle and bottle cap having the above described features.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
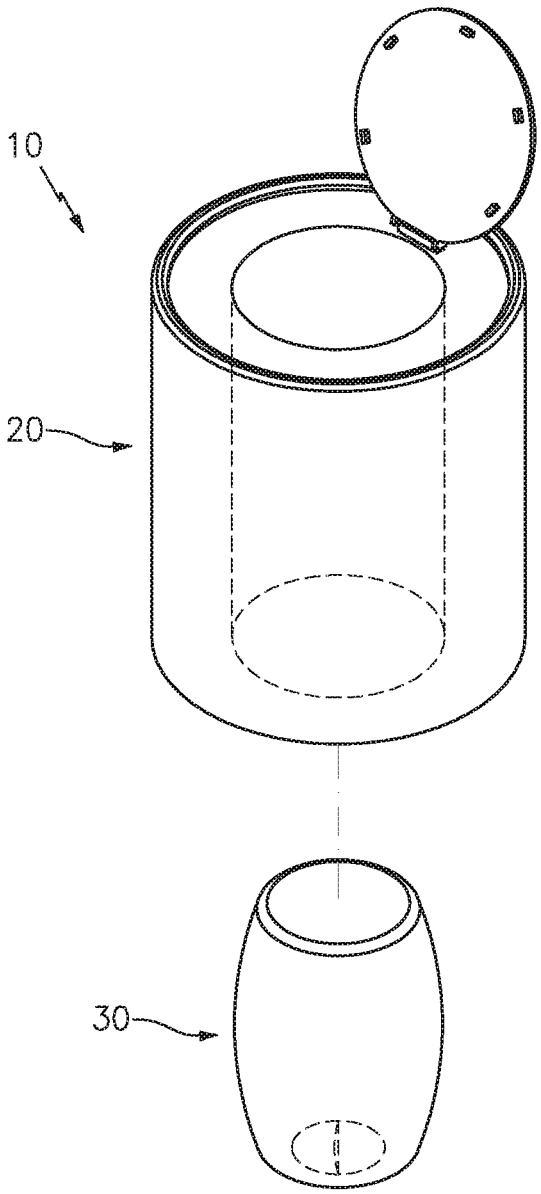
FIG. 1 is an exploded parts view of a fluid dispensing bottle cap that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as light adhesives, opposing strips of hook and loop material (i.e. Velcro®), magnets, and/or compression fittings, for example, or through manufacturing processes whereby a material connecting the objects together includes a low tensile strength and is designed to break/separate upon being manipulated by a user.

Moreover, the term "permanently secured" shall be used to describe a situation wherein two or more objects are joined together in a manner so as to prevent the same objects from being separated. Several nonlimiting examples include various adhesives such as glue or resin, hardware such as nuts and bolts, and welds, for example.

As described throughout this document, the term "complementary shape," and "complementary dimension," shall be used to describe a shape and size of a component that is identical to, or substantially identical to the shape and size of another identified component.

Although described herein as a bottle cap for use with a bottle, this is for illustrative purposes only. As such, the term "bottle" can include any type of container having any shape, size or construction material that is capable of receiving and/or storing a liquid.

FIGS. 1-5 illustrate various embodiments of a fluid dispensing cap 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 is an exploded parts view of one embodiment of a fluid dispensing bottle cap 10 that includes a cap body 20 having an internal structure for receiving a fluid reservoir 30.

Figure 2A:
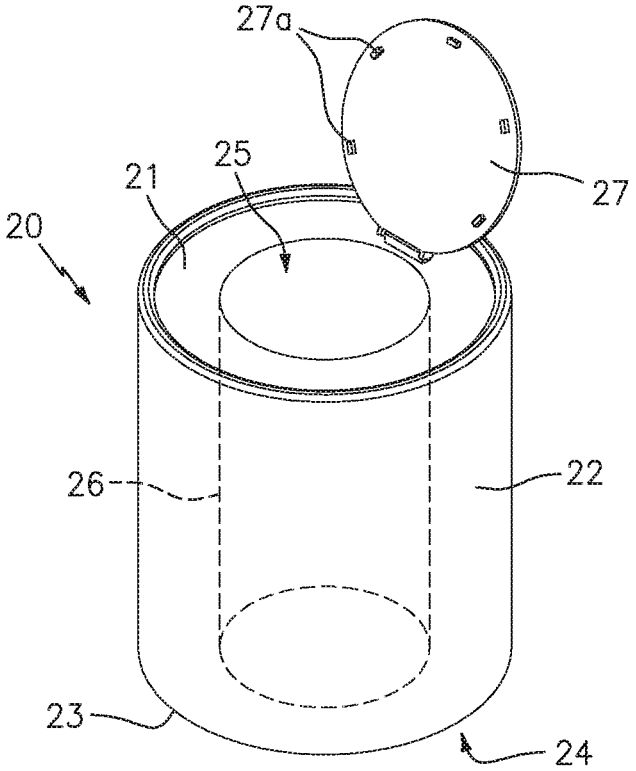
FIG. 2A is a side view of the cap body of the fluid dispensing bottle cap, in accordance with one embodiment of the invention.
Figure 2B:
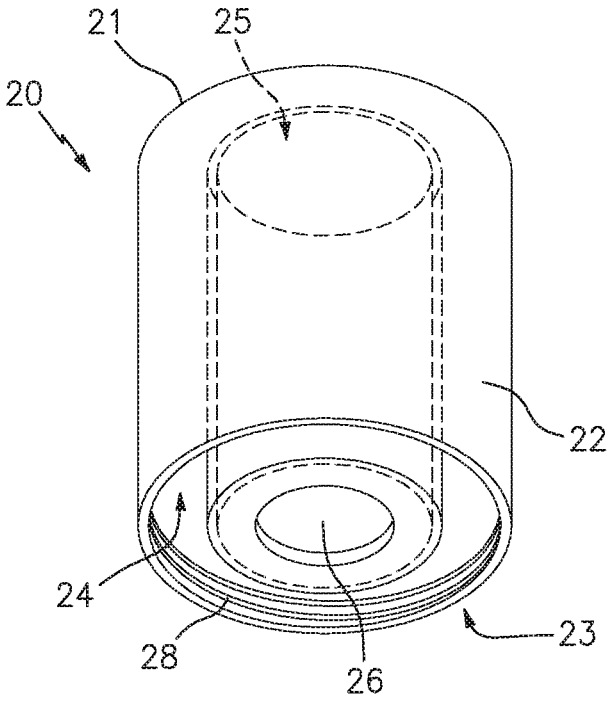
FIG. 2B is a perspective view of the cap body of the fluid dispensing bottle cap, in accordance with one embodiment of the invention.

As shown best in FIGS. 2A and 2B, the cap body 20 can include a closed top end 21, a continuous sidewall 22, and an open bottom end 23 that form an interior space 24. An aperture 25 can be disposed along the top end 21 and can be in communication with a hollow elongated channel 26 that is located within the interior space 24.

The hollow channel 26 can be constructed from any number of rigid materials and/or can be formed as an integral component of the cap body 20. In the preferred embodiment, the channel 26 can be aligned in a linear orientation with the aperture 25 so that both open ends of the channel align with the aperture.

A lid 27 can be positioned along the top end 21 at a location adjacent to the aperture 25. In one embodiment, the lid can be hingedly secured to the top end so as to transition between an open and closed orientation, in order to allow and prevent access to the aperture, respectively. In such an embodiment, the lid can include a plurality of tabs 27*a* which can engage the periphery of the aperture so as to maintain the lid in the closed position. Alternatively, the lid 27 can be removably secured to the cap in accordance with known manufacturing techniques.

A plurality of threaded elements 28 can be disposed along an inside periphery of the bottom end 23. The threaded elements can function in the expected manner to secure the cap 10 to a bottle having a plurality of complementary shaped threaded elements via a twisting motion.

As described herein, the main body can include any number of different shapes and sizes so as to be compatible with bottles of any shape and size. In the preferred embodiment, the main body 20 will be constructed from a single mold of plastic; however, other construction materials and manufacturing processes are also contemplated.

Figure 3A:
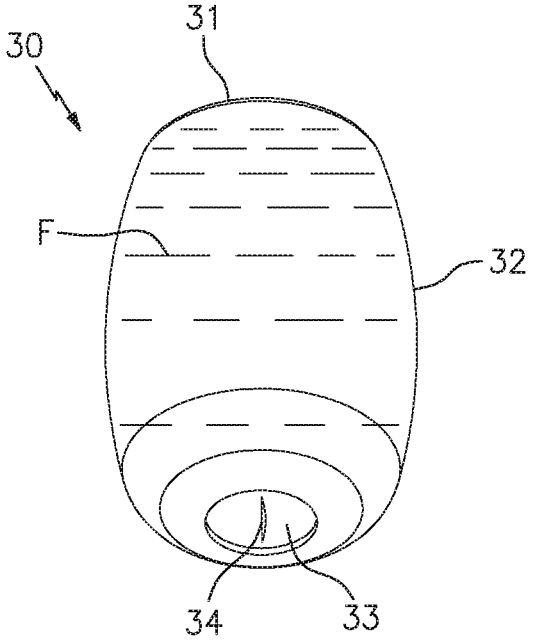
FIG. 3A is a side view of the fluid reservoir of the fluid dispensing bottle cap, in accordance with one embodiment of the invention.

FIG. 3A illustrates one embodiment of a fluid reservoir 30 for use with the cap body 20. In the present embodiment, the reservoir can be constructed from a single piece of resilient and/or elastomeric material such as rubber, for example. The reservoir can include a top end 31, continuous side wall 32, and a bottom end 33 that form a hollow interior space. A slit 34 can be positioned along the bottom end for allowing access to the interior space.

Figure 4:
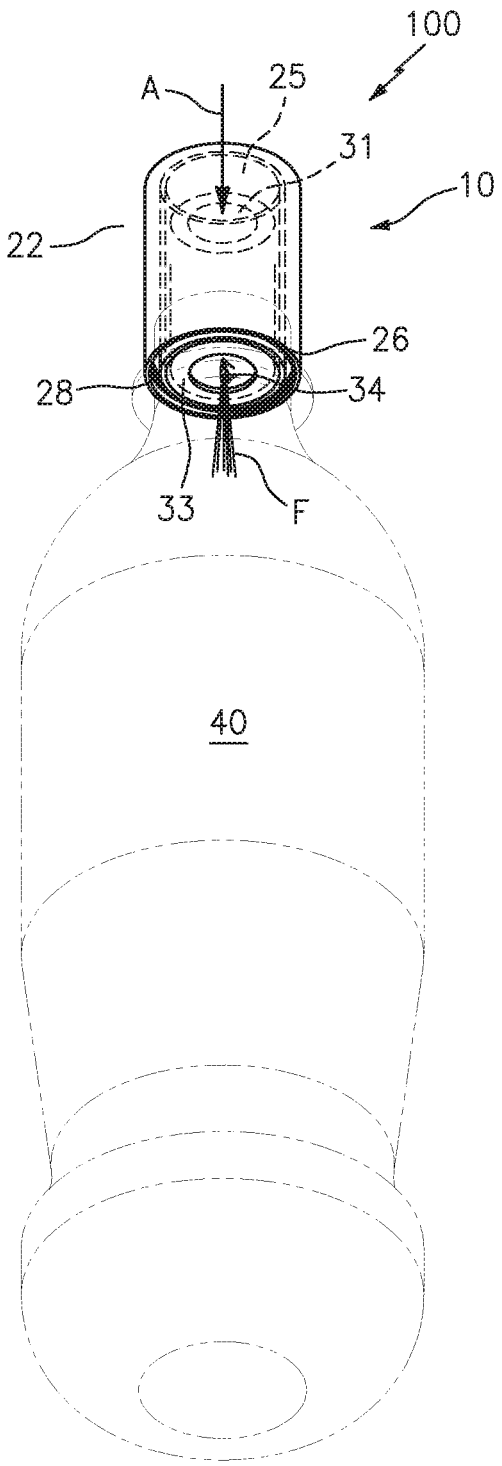
FIG. 4 is a perspective view of the fluid dispensing bottle cap in operation, in accordance with one embodiment of the invention.

As shown at FIG. 4, the reservoir 30 can include a shape and size that is complementary to the shape and size of the rigid channel 26 so as to be positioned therein. The reservoir can be secured within the rigid channel utilizing adhesives or via a plurality of locking tabs (not illustrated) so as to prevent the inserted reservoir from separating from the channel. Owing to the resilient nature of the reservoir body, the slit 34 can transition between the naturally closed position of FIG. 3A and the open position of FIG. 4 upon receiving a pressing force (arrow A) along the top end.

As will be known to those of skill in the art, application of a force onto a resilient material confined within a rigid frame causes a deformation of the resilient material while applying increased pressure to the material body from the inside out. This force functions to separate the edges of the slit 34, thereby allowing the fluid F contained within the main body to be released through the slit and into the bottle 40 to which the cap 10 is secured.

Accordingly, various embodiments contemplate production of a bottle system 100 comprising a bottle 40 that is constructed from any number of different materials such as plastic, aluminum, glass, etc., having an interior space for holding a liquid, and a bottle cap 10 that is removably secured to the bottle 40.

Figure 3B:
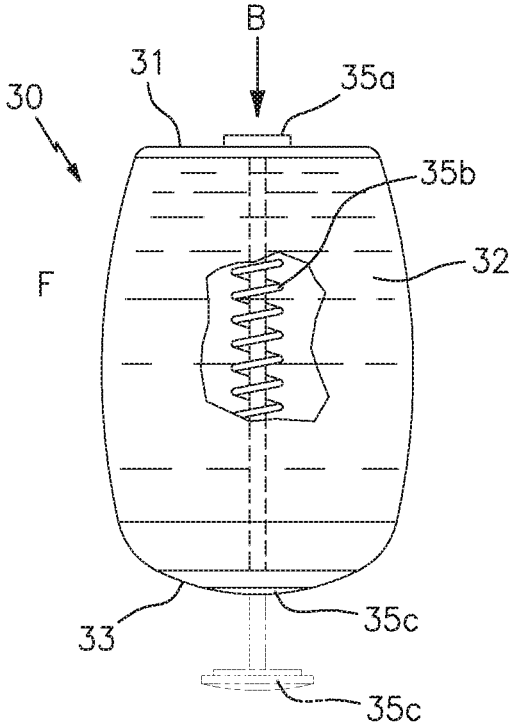
FIG. 3B is a side view of another fluid reservoir of the fluid dispensing bottle cap, in accordance with one embodiment of the invention.

FIG. 3B illustrates another embodiment of the reservoir 30 that includes a dispensing mechanism. The mechanism can comprise a valve having a plunger 35*a*, a tension body 35*b* and a plug 35*c*. The dispensing mechanism can be positioned within the reservoir body whereby a downward force B applied to the top of the reservoir 31 causes the plunger 35*a* and plug 35*c* to move in harmony with the downward force. As the plug 35*c* moves away from the bottom of the body 33, any fluid contained within the main body is released through the slit 34 which is held open by the shaft of the plug. Conversely, when no force is applied to the reservoir, a spring or other component within the tension body 35*b* maintains the valve in the closed position wherein the top of the plug 35*c* is in direct contact with the slit 34, thereby preventing stored fluid from escaping.

In either instance, the amount of fluid discharged by the reservoir 30 will be dependent on the actions of the consumer. In this regard, because the fluid will only be discharged while pressure is applied to the top of the reservoir body, a quick press (e.g., 1-2 seconds) will result in a small amount of the fluid being released into the bottle 40 whereas a longer press (e.g., 5-10 seconds) will result in a large amount of the fluid being released.

Accordingly, the consumer can add a measured amount of the fluid F into the bottle 40 containing a beverage in accordance with his or her unique palate. Once the fluid is introduced to the beverage, a user can simply shake the bottle to thoroughly mix the ingredients.

As described herein, the fluid F contained within the reservoir 30 can include any type of liquid having any number of different ingredients. Several nonlimiting embodiments include but are not limited to sweeteners such as liquid sugar, flavored syrup, coffee creamer, liquid vitamins, and/or hot sauce, for example. Of course, any number of other ingredients are also contemplated.

Figure 5:
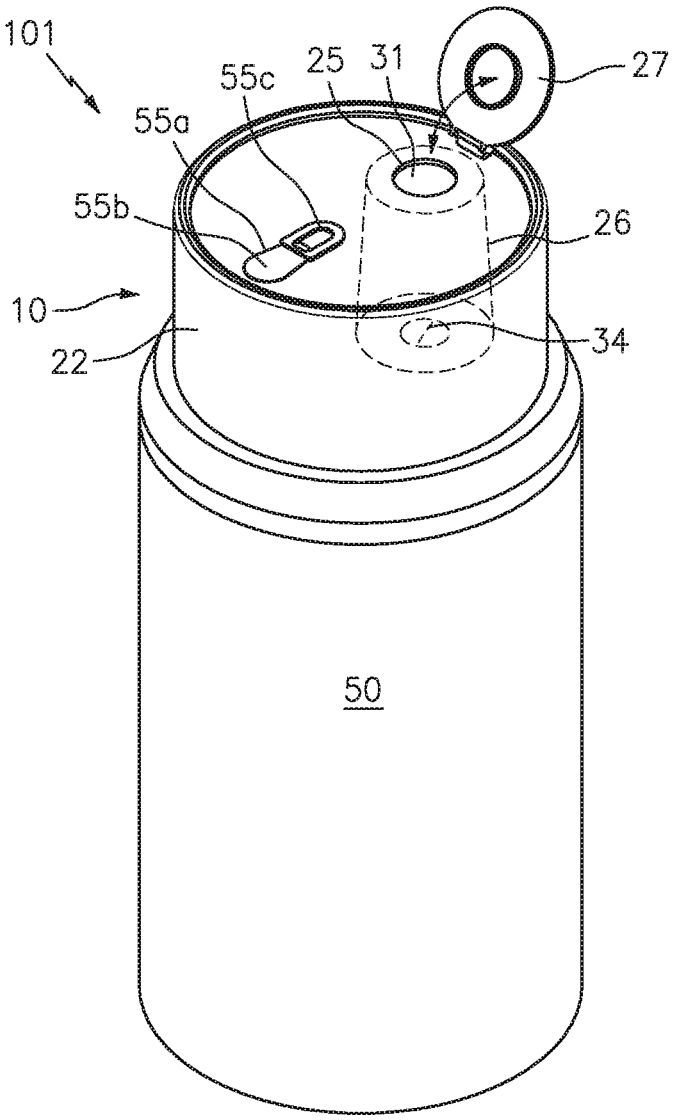
FIG. 5 is a perspective view of another fluid dispensing bottle cap in operation, in accordance with one embodiment of the invention.

Although illustrated above in conjunction with a narrow-style soda bottle, other embodiments are also contemplated. For example, FIG. 5 illustrates one embodiment of the cap 10 wherein the main body includes a large diameter (e.g., 2-4 inches) so as to be compatible with large mouth bottles and/or to be incorporated into the design of a beverage can 50. In such an embodiment, the lid can also include a drinking aperture 55*a* having a tab 55*b* and ring 55*c*. The tab and ring functioning in the known manner to allow a user to open the tab and drink through the aperture 55*a*. In such an embodiment, the cap may be permanently or removably secured to the top end of the main body.

Accordingly, various embodiments contemplate production of a system 101 comprising a can 50 that is constructed from any number of different materials such as aluminum, for example, having an interior space for holding a liquid, and a cap 10 that is permanently secured to the top end of the can 50.

Accordingly, the above described device allows users to customize the flavor profile of any beverage in a novel manner.

As described herein, one or more elements of the cap 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A bottle cap, comprising:

a cap body having a closed top end, an open bottom end and an interior space;

an aperture that is disposed along the closed top end;

a rigid hollow channel that is fixedly positioned centrally within the interior space of the cap body, said channel extending from the aperture to the open bottom end of the cap body;

a generally hollow reservoir that is positioned within the rigid hollow channel, said reservoir having a top surface that is accessible via the aperture, and a bottom surface that is positioned centrally along the open bottom end, wherein the reservoir is configured to store a fluid and to selectively and repeatedly discharge a portion of the fluid through the open bottom end upon receiving a pressing force along the top surface, wherein the reservoir includes a generally hollow main body section having a resilient slit along the bottom end.

2. The bottle cap of claim 1, wherein the reservoir includes a shape and size that is complementary to a shape and size of the rigid channel.

3. The bottle cap of claim 2, wherein the reservoir is permanently secured within the rigid channel.

4. The bottle cap of claim 1, wherein the reservoir is constructed from a single piece of resilient material.

5. The bottle cap of claim 1, further comprising:

a lid that is secured along the closed top end of the cap body, said lid being configured to transition from a closed orientation to an open orientation, wherein in the closed orientation the lid covers the aperture and in the open position the lid does not cover the aperture.

6. The bottle cap of claim 1, further comprising:

a plurality of threaded elements that are disposed along the open bottom end of the cap body, said threaded elements being configured to engage complementary threaded elements on a bottle to which the cap is to be secured, wherein the plurality of threaded elements are positioned outside of the rigid hollow channel.

7. A bottle system, comprising:

a bottle body having a hollow interior space and an open top end; and a bottle cap that includes a cap body having a closed top end, an open bottom end and an interior space, an aperture that is disposed along the closed top end of the cap body, a rigid hollow channel that is fixedly positioned centrally within the interior space of the cap body, said channel extending from the aperture to the open bottom end of the cap body, a generally hollow reservoir that is positioned within the rigid hollow channel, said reservoir having a top surface that is accessible via the aperture, and a bottom surface that is positioned adjacent to the open top end of the bottle body, wherein the bottle cap is removably secured to the open top end of the bottle, and the reservoir is configured to store a fluid and to selectively and repeatedly discharge a portion of the fluid into the hollow interior space of the bottle body upon receiving a pressing force along the top surface, wherein the reservoir includes a generally hollow main body section having a resilient slit along the bottom end.

8. The system of claim 7, wherein the reservoir includes a shape and size that is complementary to a shape and size of the rigid channel.

9. The system of claim 8, wherein the reservoir is permanently secured within the rigid channel.

10. The system of claim 7, wherein the reservoir is constructed from a single piece of resilient material.

11. The system of claim 7, further comprising:

a lid that is secured along the closed top end of the cap body, said lid being configured to transition from a closed orientation to an open orientation, wherein in the closed orientation the lid covers the aperture and in the open position the lid does not cover the aperture.

12. The system of claim 7, further comprising:

a plurality of threaded elements that are disposed along the open bottom end of the cap body at a location outside of the rigid hollow channel, and a plurality of complementary threaded elements that are disposed along the open top end of the bottle, said threaded elements and complementary threaded elements functioning to removably secure the bottle cap to the bottle.

* * * * *